US005347241A

United States Patent [19]

Panaretos et al.

[11] Patent Number: 5,347,241

[45] Date of Patent: Sep. 13, 1994

[54] DUAL JUNCTION BACK-TO-BACK MICROSTRIP FOUR-PORT CIRCULATORS

[75] Inventors: Steve K. Panaretos, Los Angeles; Clifton Quan, Arcadia, both of Calif.

[73] Assignee: Hughes Aircraft Company, Los Angeles, Calif.

[21] Appl. No.: 14,586

[22] Filed: Feb. 8, 1993

[51] Int. Cl.[5] ..... H01P 1/387

[52] U.S. Cl. ..... 333/1.1; 333/238

[58] Field of Search ..... 333/1.1, 238

[56] References Cited

U.S. PATENT DOCUMENTS 3,534,296 10/1970 Carr ..... 333/1.1

4,494,083 1/1985 Josefsson et al. ..... 333/238 X

FOREIGN PATENT DOCUMENTS 240101 10/1988 Japan ..... 333/1.1

55406 2/1990 Japan ..... 333/1.1

*Primary Examiner*—Paul Gensler

*Attorney, Agent, or Firm*—L. A. Alkov; W. K. Denson-Low

[57] ABSTRACT

A dual junction back-to-back four-port microstrip circulator made up of two three-port single junction circulators whose substrates lay back-to-back and are interconnected with a coaxial feedthrough. When used in an active antenna array application, the transmit and receive ports will be located on different levels of the device. The back-to-back configuration allows sharing either a single magnet for biasing or a single magnetic shield carrier for bias return, with a magnet on top of each substrate. The circulator has the advantages of small size and operation over a wide frequency band.

17 Claims, 4 Drawing Sheets

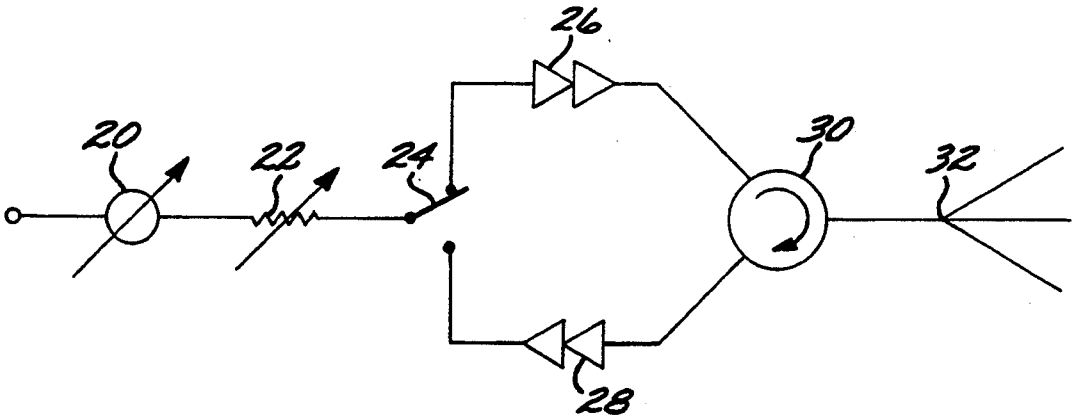
FIG. 1 PRIOR ART
FIG. 2A
PRIOR ART
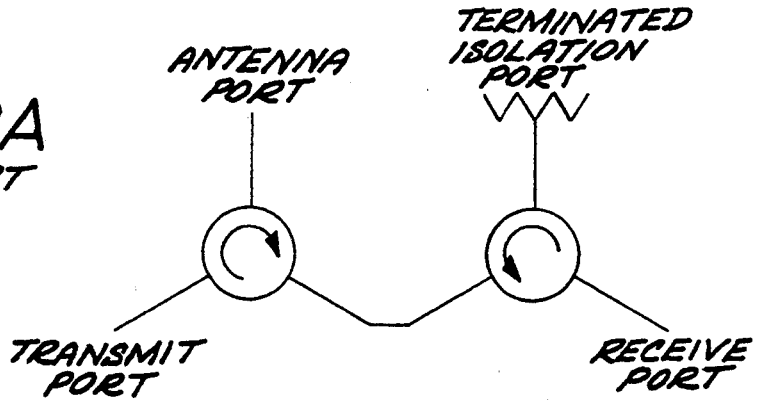
FIG. 2B
PRIOR ART
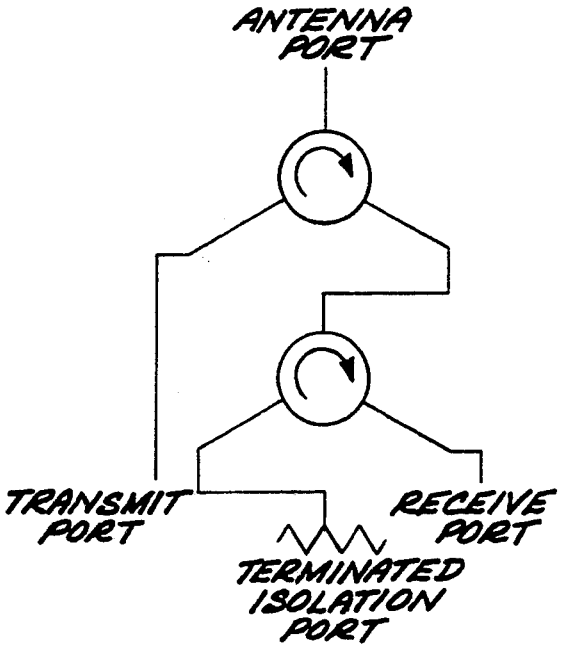

DUAL JUNCTION BACK-TO-BACK MICROSTRIP FOUR-PORT CIRCULATORS

BACKGROUND OF THE INVENTION

This invention relates to RF circulator devices, and more particularly to four-port circulators.

Circulators are necessary in active array antennas to route RF energy from the transmit/receive ("T/R") modules to the radiating elements and vice versa. Thus, for example, as shown in FIG. 1, a circulator 30 conducts RF energy routed via variable phase shifter 20, variable impedance 22, T/R switch 24 and high power amplifier 26 to the radiating element 32, and from the radiating element 32 to lower noise amplifier 28, and to attenuator 22 and phase shifter 24 via the T/R switch 24.

A four-port circulator has been incorporated into a flared notch radiator, resulting in improved impedance match and isolation, as described in U.S. Pat. No. 5,264,860 entitled "Metal Flared Radiator with Separate Isolated Transmit and Receive Ports", by Clifton Quan, and commonly assigned with the present application.

A conventional method of realizing miniature four-port circulators is to combine two single junction three-port microstrip circulators in a coplanar fashion either side-to-side or end-to-end, as shown in FIGS. 2A and 2B, respectively. Dual junction four-port circulators built in this fashion can be made to operate across a wide (>40%) frequency band. Coplanar integration results in a four-port circulator that is physically larger (wider for the side-to-side configuration; longer for the end-to-end configuration) than the original three-port circulator. These approaches have physical size limitations because of field interaction as the magnets from the two three-port junctions get close together. These size restrains can limit the ability to design antenna lattices that will meet certain radar and radar cross-section (RCS) requirements. Also, these field interactions that occur when the magnets are too close to each other can result in degraded RF circulator performance.

The increase in physical size due to this type of coplanar integration can result in a significant penalty in array depth and weight since potentially thousands of these circulators could be used in a single antenna system. The large size of the dual junction coplanar four-port circulator also limits how compact the antenna array lattice can be which in turn limits the antenna and radar cross-section (RCS) performances.

Single junction four-port circulators have been realized in microstrip. They can be made smaller than the dual junction coplanar four-port circulator, but to date they only operate across a narrower frequency band.

It is therefore an object of this invention to provide a four-port circulator of reduced size than can be achieved using conventional coplanar integration techniques.

It is a further object to provide a four-port circulator formed by two three-port units which operates over a wider frequency band than single junction four-port units.

SUMMARY OF THE INVENTION

The invention is a dual junction back-to-back four-port microstrip circulator comprising two three-port single junction circulators whose substrates lay back-to-back and are interconnected with a coaxial feedthrough. The transmit and receive ports will therefore be located on different levels of the circulator. The back-to-back configuration allows sharing either a single magnet for biasing or a single magnetic shield carrier for bias return (with a magnet on top of each substrate).

The back-to-back configuration allows integrating two three-port circulators to create the four-port circulator; yet the four-port will occupy virtually the same area as that of a single three-port unit. This is smaller than can be achieved using coplanar integration techniques. The sharing of either a single magnet or a magnetic shield carrier eliminates the problems of magnetic field interactions commonly occurring when two magnets are placed in closed proximity of each other. A microstrip-to--coax--to-microstrip interconnect not only makes the back-to-back configuration possible, but also, when integrated into the radiator, allows the radiator assembly to have an extra degree of freedom to fit into a number of antenna array lattices. Finally, four-port circulators formed by two three-port units in accordance with this invention operates over a wider frequency band than single junction four-port units.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 illustrates a conventional active array arrangement employing circulators to route RF energy between the T/R modules and the radiating elements.

FIGS. 2A and 2B illustrate conventional coplanar arrangements for combining two three-port microstrip circulators into a four-port circulator.

DETAILED DESCRIPTION OF THE PREFERRED EMBODIMENT

Figure 3A:
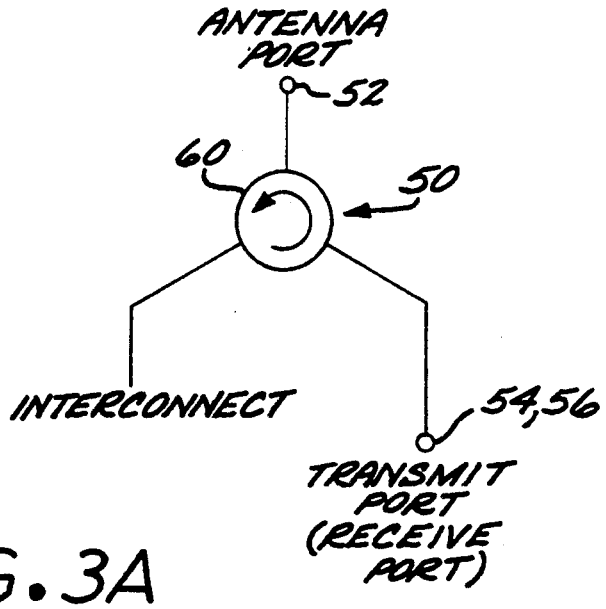
FIGS. 3A and 3B represent simplified schematic views of a four-port circulator in accordance with the present invention.
Figure 3B:
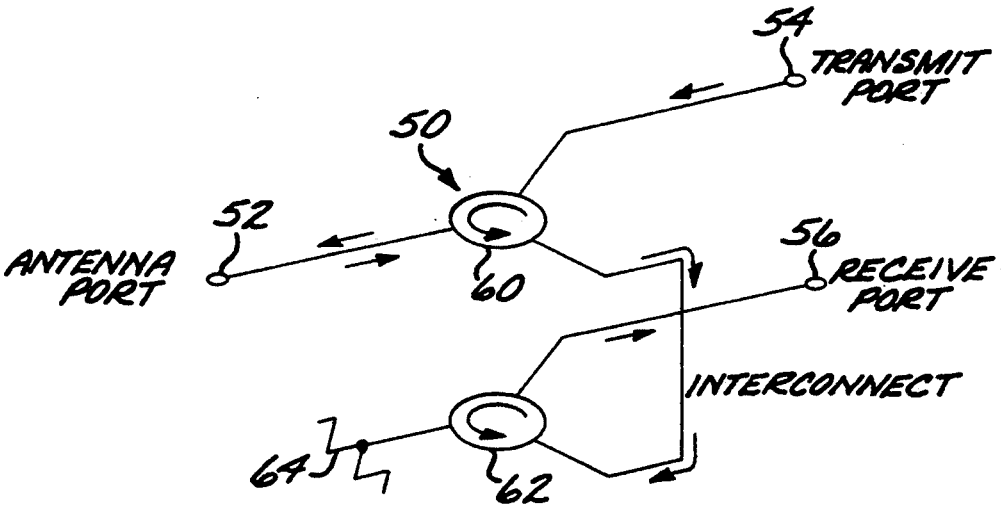

The invention involves a different method of integrating two single junction circulators to form a dual junction four-port unit. This integration is non-planar and involves joining the two microstrip circulators back-to-back (FIG. 3A and 3B). The electrical groundplane shared by the two circulator substrates (combination of ferrite and ceramic materials) lies in the center of this assembly. The microstrip conductor center strips face away from each other on opposite sides of the dual substrate assembly. The two microstrip circuits are connected to each other via a coaxial feedthrough that runs through both substrates and the groundplane. Magnetic field bias can be achieved by positioning magnets on top of the two ferrite substrates (spacers are needed) with a magnetic shielded carrier underneath and between the two ferrite substrates. The carrier is made of a magnetic alloy such as Kovar, iron or steel, and provides a magnetic return for the field generated by the two magnets and provides a shield to prevent the two magnets from interacting with each other in close proximity.

FIGS. 3A and 3B show simplified top and perspective diagrammatic views illustrative of the multi-level architecture of a four-port circulator 50 embodying this invention. The device 50 includes an antenna port 52, a transmit port 54 and a receive port 56. The antenna port 52 is connected to a first port of a first three-port circulator 60. The transmit port 54 is connected to a second port of the circulator 60. The third port of the circulator is connected via an interconnect to a first port of a second three-port circulator 62 disposed on a second level of the device. The receive port 56 on the second level is connected to a second port of circulator 62. The third port of the circulator is connected to a balanced load 64.

Figure 4:
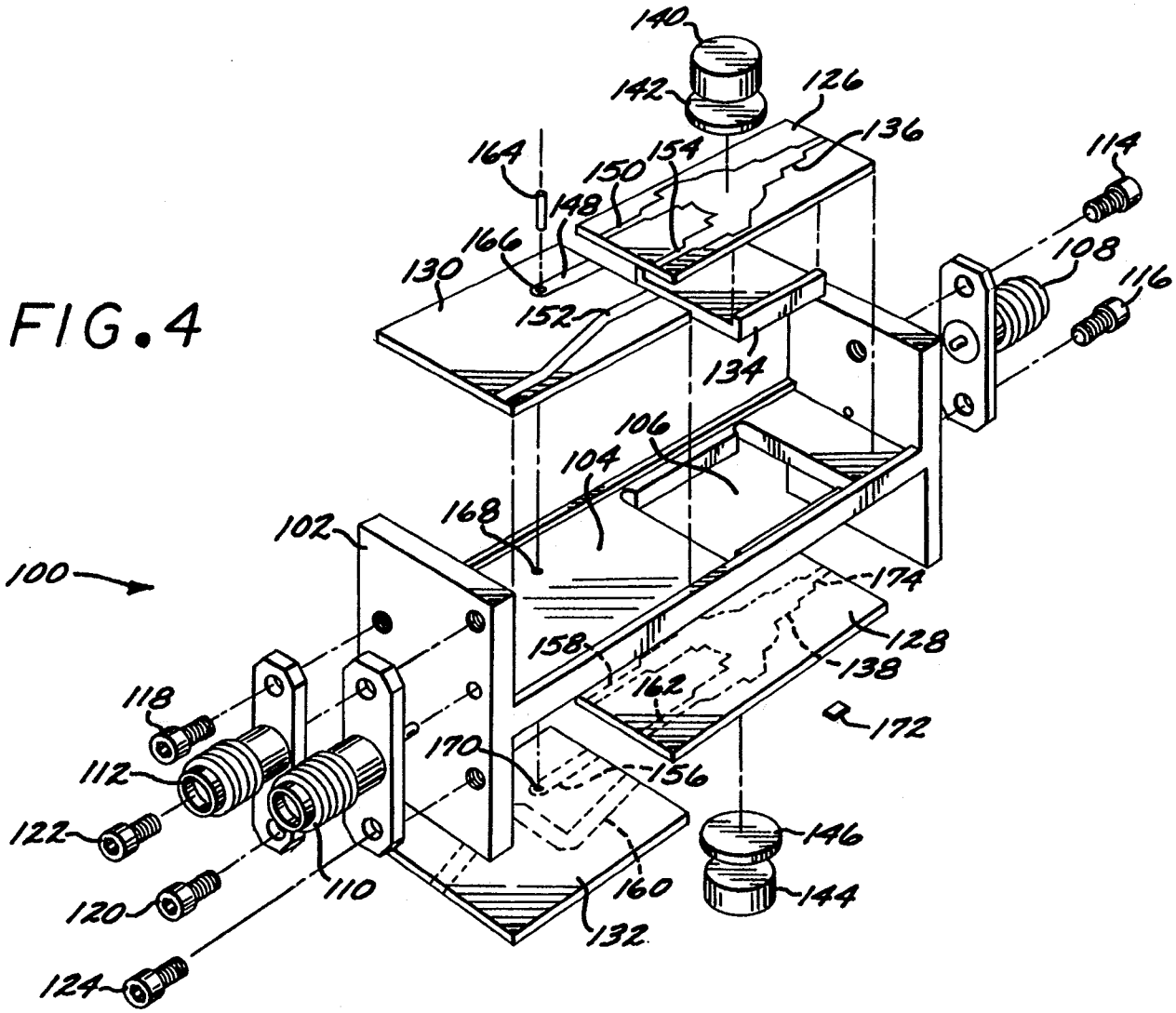
FIG. 4 is an exploded view of a dual junction back-to-back four-port circulator with a common magnetic carrier and two magnets in accordance with this invention.

FIG. 4 is an exploded perspective view of a first embodiment of a four-port circulator 100 in accordance with the invention. A metallic frame structure 102 provides structural support and integrity for the elements of the device as well as a common groundplane element 104. In this embodiment the structure 102 can be aluminum or of the same material as the carrier 134. Coaxial connectors 108, 110 and 112 are secured to the structure 102 by fasteners 114, 116, 118, 120, 122 and 124, respectively. The center conductors of the coaxial connectors are connected to microstrip conductors defined on substrates 126, 130 and 132, respectively. A rectilinear opening 106 is formed in the groundplane element 104, to receive a magnetic shielded carrier 134, fabricated of a magnetic alloy.

Disposed on opposite sides of the groundplane 104 and the carrier 134 are the substrates 126 and 128. These substrates are fabricated of a combination of ferrite and ceramic materials in this embodiment, and have respective conductive patterns 136 and 138 defined on opposite sides thereof by conventional photolithographic techniques. The size and configurations of the conductive patterns 136 and 138 are conventional patterns used in the construction of microstrip circulators. An exemplary material from which the substrates 126 and 128 may be fabricated is magnesium manganese ferrite. The patterns 136 and 138 define microstrip conductor strips, which face away from each other on opposite sides of the substrate assembly.

Magnetic field bias is provided by magnets 140 and 144 positioned on top of respective spacers 142 and 146 which rest on top of the respective conductive patterns 136 and 138. The spacers 142 and 146 are made of a low loss dielectric material, such as fused silica glass or Rexolite.

In addition to the substrates 126 and 128, dielectric substrates 130 and 132 are disposed on opposite sides of the groundplane 104. The substrates 130 and 132 in turn have conductive strips defined thereon which are electrically connected to corresponding microstrip conductive strips on substrates 126 and 128. Thus, conductor 148 is connected to conductor 150 of substrate 126, and conductor 152 is electrically connected to conductor 154. The opposite end of conductor 152 is connected to the center conductor of coaxial connector 110. Similarly, regarding the conductive strips formed on the substrates 132 and 128, strip 156 is electrically connected to strip 158, and one end of strip 160 is connected to strip 162. The other end of the strip 160 is connected to the center conductor of connector 112.

A pin 164 provides an electrical interconnection between the conductive strip 148 formed on the upper substrate 130 and the conductive strip 156 formed on the lower surface of the lower substrate 132. The pin 164 extends through holes 166, 168 and 170 formed in the substrate 130, the groundplane 104 and the substrate 132, respectively. The hole 168 is made large enough so that the pin 164 is not electrically connected to the groundplane 104.

A chip resistor 172 is connected to the strip 138 at 174, to provide a balanced load for the device 100. It will be apparent that the device 100 provides an effective four-port circulator as shown in FIGS. 3A and 3B. Coaxial connector 108 provides the antenna port, connector 110 provides the transmit port, and connector 112 provides the receive port for the device.

Figure 5:
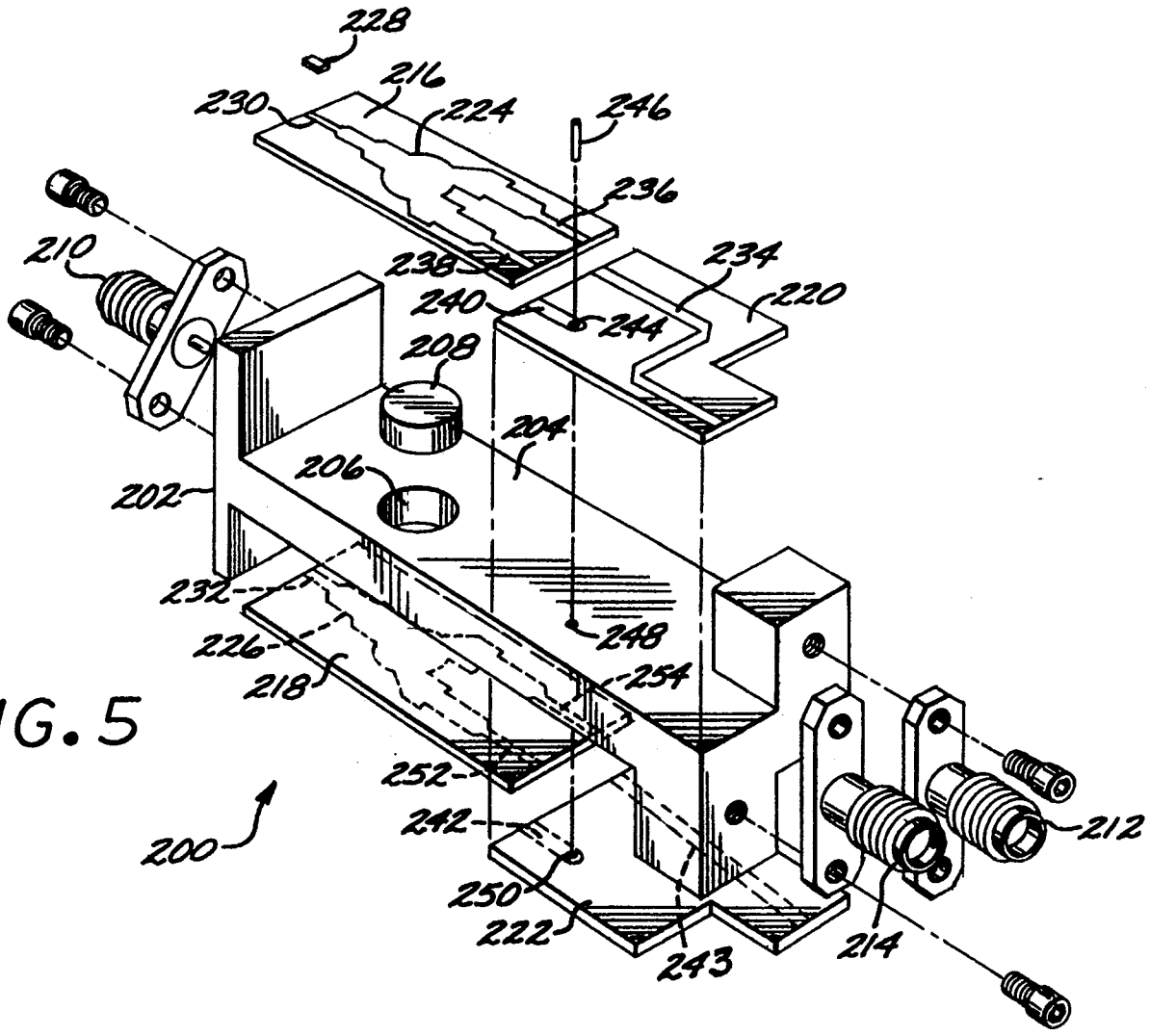
FIG. 5 is an exploded view of an alternate embodiment of a dual junction four-port back-to-back circulator with a common magnet in accordance with this invention.

FIG. 5 shows an alternative embodiment of a four-port circulator 200 embodying the invention. This embodiment employs a common magnet, instead of two magnets as in the device 100 of FIG. 4. The device 200 employs a metallic frame structure 202 which provides mechanical support and a groundplane 204. The structure 202 is preferably made of aluminum. An opening 206 is defined in the groundplane 204, in which the common magnet 208 is disposed. The thickness of the groundplane 204 is therefore approximately the same thickness as the magnet 208. Coaxial connectors 210, 212 and 214 are secured to the structure 202 as shown, and include center conductors electrically connected to particular microstrip center conductors defined on the respective substrates 218, 220 and 222.

Substrates 216 and 218 are disposed on opposite sides of the groundplane 204 above and below the magnet 208, and are fabricated of a combination of ferrite and ceramic materials. Respective conductive patterns 224 and 226 are defined on oppositely facing surfaces of the substrates 216 and 218. A chip resistor 228 is connected to the conductor strip 230 comprising pattern 224, and serves as the balanced load of the arrangement shown in FIG. 3B. The center conductor of coaxial connector 210 is connected to microstrip conductor 232 comprising pattern 226.

The device 200 further includes a pair of dielectric substrates 220 and 222 disposed on either side of the groundplane 204 adjacent the substrates 216 and 218. The substrates have formed on oppositely facing sides thereof microstrip conductor strips 234, 240 (substrate 220) and 242, 244 (substrate 222). One end of conductor strip 234 is electrically connected to strip 236 (substrate 216). The other end of strip 234 is connected to the center conductor of connector 214. One end of strip 240 is connected to strip 238. The other end of the strip 240 is connected to the interconnect pin 246 disposed through hole 244 in substrate 220, through hole 248 in groundplane 204 and through hole 250 in substrate 222 to make electrical contact with conductive strip 242. The hole 248 is large enough so that the pin 246 does not make contact with the groundplane. Conductive strip 242 is electrically connected to conductive strip 252 (substrate 218). One end of conductive strip 243 is connected to strip 254; the other end is connected to the center conductor of connector 212.

In this embodiment, the connector 210 serves as the antenna port for the four-port circulator 200. Connector 212 serves as the transmit port, and connector 214 serves as the receive port.

This invention is particularly useful for wideband active array antennas. The dual junction back-to-back four-port circulator in accordance with the invention provides improved isolation and impedance match between the radiator element and transmit and receive ports of T/R modules. Since this four-port occupies virtually the same area as that of a three-port circulator, incorporating the invention in an array in place of the conventional circulator will not impose any added weight or depth penalties on the antenna.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A dual junction back-to-back four-port microstrip circulator, comprising first and second three-port single junction circulators each comprising a substrate on which a conductive pattern is formed, said substrates of said first and second circulators situated back-to-back, one port of said first circulator being connected to a port of said second circulator via an interconnection extending through said substrates, and means for providing magnetic field bias to said first and second circulators.

2. The circulator of claim 1 further comprising a balanced load coupled to one port of one of said three-port circulators.

3. The circulator of claim 1 wherein said means for providing magnetic field bias comprises a shared magnetic shield carrier disposed between said substrates and first and second magnets disposed adjacent oppositely facing surfaces of said substrates, said substrates and said carrier being sandwiched between said magnets.

4. The circulator of claim 3 wherein said magnetic carrier provides a magnetic return for the magnetic field generated by said two magnets and provides a shield to prevent said magnets from interacting with each other.

5. The circulator of claim 4 wherein said carrier is fabricated from a magnetic alloy.

6. The circulator of claim 3 further comprising first and second nonmagnetic spacers disposed respectively between said first magnet and said first circulator substrate and between said second magnet and said second circulator substrate.

7. The circulator of claim 1 wherein said means for providing magnetic field bias comprises a common magnet shared by said first and second three-port circulators.

8. The circulator of claim 7 wherein said common magnet is disposed between said substrates of said three-port circulators.

9. The circulator of claim 1 wherein said substrates are. fabricated of a combination of ferrite and ceramic materials.

10. A four-port circulator including two three-port circulators arranged in a back to back configuration, comprising:

a magnetic shield carrier member;

first and second substrates comprising a ferrite material sandwiching said carrier member, said substrates comprising respective first and second conductive patterns formed on oppositely facing surfaces of said substrates;

first and second magnets spaced from said oppositely facing surfaces to provide magnetic field bias to signals carried by said respective first and second patterns, said carrier providing a magnetic return for the magnetic field generated by said magnets and a shield to prevent said magnets from interacting with each other;

said first pattern defining three ports of a first three-port circulator for which magnetic field bias is provided by said first magnet, said second pattern defining three ports of a second three-port circulator for which magnetic field bias is provided by said second magnet;

interconnection means for connecting a first port of said first three-port circulator to a corresponding first port of said second three-port circulator;

a groundplane member having first and second opposed electrically conductive surfaces, said groundplane element extending adjacent said carrier member;

third and fourth substrates fabricated of a dielectric material, said third substrate disposed on said first conductive surface adjacent said first substrate, said fourth substrate disposed on said second conductive surface adjacent said second substrate; and wherein said interconnecting means comprises respective first and second conductive strips formed respectively on opposing surfaces of said third and fourth substrates, said first strip electrically connected to said first port of said first circulator, said second strip electrically connected to said first port of said second circulator, and a conductive element inserted through said third substrate, an opening in said groundplane element, and said fourth substrate and electrically connected to said first and second conductive strips.

11. The circulator of claim 10 wherein said first and second magnets are aligned one above the other in a separated relationship.

12. The circulator of claim 11 wherein said first and second magnets are spaced above said respective first and second surfaces by spacer elements.

13. The circulator of claim 10 wherein said first substrate and said first conductive pattern define microstrip transmission lines for coupling RF signals to and from said first circulator, and said second substrate and said second conductive pattern define microstrip transmission lines for coupling RF signals to and from said second circulator.

14. The circulator of claim 10 further comprising a matched load connected to a second port of said second circulator, and wherein the four-ports of said four-port circulator are taken as the second and third ports of said first three-port circulator, said second port and the third port of said second three-port circulator.

15. A four-port circulator including two three-port circulators arranged in a back to back configuration, comprising:

a groundplane member having first and second electrically conductive opposed surfaces;

first and second substrates comprising a ferrite material sandwiching said ground-plane member, said substrates comprising respective first and second conductive patterns formed on oppositely facing surfaces of said substrates;

means for providing magnetic field bias to signals carried by said respective first and second patterns, said bias means comprising a magnet disposed in an opening formed in said groundplane member and disposed between said substrates;

said first pattern defining three ports of a first three-port circulator for which magnetic field bias is provided by said magnet, said second pattern defining three ports of a second three-port circulator for which magnetic field bias is provided by said magnet;

interconnection means for connecting a first port of said first three-port circulator to a corresponding first port of said second three-port circulator;

third and fourth substrates fabricated of a dielectric material, said third substrate disposed on said first conductive surface adjacent said first substrate, said fourth substrate disposed on said second conductive surface adjacent said second substrate; and wherein said interconnecting means comprises respective first and second conductive strips formed respectively on opposing surfaces of said third and fourth substrates, said first strip electrically connected to said first port of said first circulator, said second strip electrically connected to said first port of said second circulator, and a conductive element inserted through said third substrate, an opening in said groundplane element, and said fourth substrate and electrically connected to said first and second conductive strips.

16. The circulator of claim 15 wherein said first substrate and said first conductive pattern define microstrip transmission lines for coupling RF signals to and from said first circulator, and said second substrate and said second conductive pattern define microstrip transmission lines for coupling RF signals to and from said second circulator.

17. The circulator of claim 15 further comprising a matched load connected to a second port of said second circulator, and wherein the four-ports of said four-port circulator are taken as the second and third ports of said first three-port circulator, said second port and the third port of said second three-port circulator.

* * * * *